US005111625A

United States Patent [19]

Simpfendorfer et al.

[11] Patent Number: 5,111,625

[45] Date of Patent: May 12, 1992

[54] MACHINE FOR CONTOUR GRINDING OUTSIDE PERIPHERAL SURFACES OF WORKPIECES

[75] Inventors: Dieter Simpfendorfer, Mühlheim; Walter Weil; Phon Dao-Xuan, both of Frankfurt, all of Fed. Rep. of Germany

[73] Assignee: Diskus Werke Frankfurt am Main Aktiengesellschaft, Frankfurt-Fechenheim, Fed. Rep. of Germany

[21] Appl. No.: 702,836

[22] Filed: May 20, 1991

[30] Foreign Application Priority Data

Jun. 1, 1990 [DE] Fed. Rep. of Germany ..... 4017716

[51] Int. Cl.[5] ..... B24B 55/02

[52] U.S. Cl. ..... 51/267

[58] Field of Search ..... 51/266, 267, 262

[56] References Cited

U.S. PATENT DOCUMENTS 4,176,500 12/1979 Bourgoin ..... 51/267

*Primary Examiner*—Roscoe V. Parker

*Attorney, Agent, or Firm*—Dvorak and Traub

[57] ABSTRACT

A machine for contour grinding outside peripheral surfaces of workpieces comprises a grinding wheel, a guard hood covering said grinding wheel, and a nozzle for supplying a cooling and lubricating fluid to the peripheral surface of said grinding wheel. The nozzle flares toward the peripheral surface of the grinding wheel and is open toward said peripheral surface and on that side which faces opposite to the direction of rotation of the grinding wheel is provided with a lip, which is adjustable toward and away from said peripheral surface. To ensure an effective supply of said cooling and lubricating fluid to said grinding wheel even when it is rotating at a high surface speed, said nozzle is pivoted on an axis which is parallel to the axis of rotation of the grinding wheel and said nozzle is provided on that side which faces in the direction of rotation of the grinding wheel with a motor-adjustable valve member for controlling the volume flow rate at which the cooling and lubricating fluid is discharged from said nozzle.

6 Claims, 3 Drawing Sheets

MACHINE FOR CONTOUR GRINDING OUTSIDE PERIPHERAL SURFACES OF WORKPIECES

BACKGROUND OF THE INVENTION

1. Field of the Invention

This invention relates to a machine contour grinding outside peripheral surfaces of workpieces, particularly to means for supplying a cooling and lubricating fluid in such a machine, which comprises a grinding wheel that is covered by a guard hood and in which said means for supplying a cooling and lubricating fluid comprise a nozzle, which flares toward the peripheral surface of the grinding wheel and is open toward said peripheral surface and on that side which faces opposite to the direction of rotation of the grinding wheel is provided with a lip, which is adjustable toward and away from said peripheral surface.

2. Description of the Prior Art

In the contour grinding of outside peripheral surfaces of workpieces the quantity of heat generated in the contact zone between the grinding wheel and the workpiece must be minimized and must be dissipated as fast and as completely as possible by a coolant. For this reason a cooling and lubricating fluid is supplied to said contact zone. As the surface speed of the grinding wheel increases, the ingress of said fluid into the nip between the grinding wheel and the workpiece is progressively opposed by the cushion of air which surrounds the grinding wheel. In known systems the cooling and lubricating fluid is discharged from nozzlelike orifices under high pressure and at a high volume flow rate so that the fluid can penetrate through said air cushion.

It is known that this can be accomplished by the use of free-jet nozzles or thrust nozzles. Free-jet nozzles discharge a freely flowing jet of cooling and lubricating fluid and said jet owing to its high velocity is intended to penetrate at a suitable location the air cushion which surrounds the grinding wheel. That object can be accomplished only by the provision of an expensive structure. Thrust nozzles substantially conform to the curvature of the peripheral surface of the grinding wheel and are closed on all sides except for an opening which faces the peripheral surface of the grinding wheel so that the cooling and lubricating fluid can more effectively enter the boundary layer of air. But thrust nozzles will become increasingly less effective as the diameter of the grinding wheel is decreased by wear.

From Published German Application 20 23 200 it is further known to provide a nozzle which flares toward and is open to the grinding wheel and the extends over the width of the grinding wheel and is provided on that side which faces opposite to the direction of rotation of the grinding wheel with a lip, which is adjustable toward and away from the peripheral surface of the grinding wheel and adapted to inhibit the formation of an air cushion on said peripheral surface adjacent to said nozzle.

SUMMARY OF THE INVENTION

It is an object of the invention to provide a machine for contour grinding the peripheral surfaces of workpieces, particularly at a high surface speed, with improved means for supplying a cooling and lubricating fluid at a controlled or automatically controlled volume flow rate.

In a grinding machine of the kind described first hereinbefore that object is accomplished in accordance with the invention in that the said nozzle is pivoted on an axis which is parallel to the axis of rotation of the grinding wheel and said nozzle is provided on that side which faces in the direction of rotation of the grinding wheel with a motor-adjustable valve member for controlling the volume flow rate at which the cooling and lubricating fluid is discharged from said nozzle. The orientation of the nozzle can be adjusted and is preferably radial and the nozzle defines an interior cavity, which is closed except for an outlet opening, which serves to discharge the cooling and lubricating fluid through a controlled flow area and is defined elsewhere only by narrow gaps.

Specifically, the nozzle is accommodated within the guard hood, which covers the peripheral surface of the grinding wheel with such a small clearance that the formation of a stable air cushion will be restricted, even during a rotation of the grinding wheel at a high surface speed. Besides, the nozzle is so shaped that the thin layer of air which remains on the peripheral surface of the grinding wheel will be deflected by the lip to flow on the outside surface of the nozzle so that said air layer cannot enter the interior of the nozzle.

As a result, the air cushion which is disturbing in conventional means for supplying the cooling and lubricating fluid is entirely eliminated within the nozzle so that the interior cavity of the nozzle can be filled with the cooling and lubricating fluid under low pressure and the rotational movement of the grinding wheel can be utilized to accelerate said cooling and lubricating fluid emerging through the outlet opening of the nozzle to a high peripheral velocity. The entraining of said cooling and lubricating fluid will not be restricted by the wear of the grinding wheel if a grinding wheel is used which consists of a single layer so that it will be substantially constant in diameter, as is conventional in high-speed grinding operations.

The center line of the flaring nozzle may be inclined opposite to the direction of rotation of the grinding wheel at an angle of about 45° to the line which connects the centers of the grinding wheel and the workpiece and a drain passage for the cooling and lubricating fluid may open inside the guard hood toward the peripheral surface of the grinding wheel and may have a center line which is a mirror image of the center line of the nozzle with respect to said connecting line. In that case a fracture of the grinding wheel will have the result that the forces acting on the inner peripheral wall of the guard hood will be transmitted by webs of said hood onto the centering flange of the outer peripheral wall of the guard hood and will thus be taken up by the grinding head. Because the guard hood is secured to a centering extension of the grinding head, fragments of the grinding wheel which fly off in a tangential direction will stress the fixing screws only by impact shear loads when the frictional resistance between the fixing surfaces has been overcome.

DETAILED DESCRIPTION OF THE PREFERRED EMBODIMENT

Figure 1:
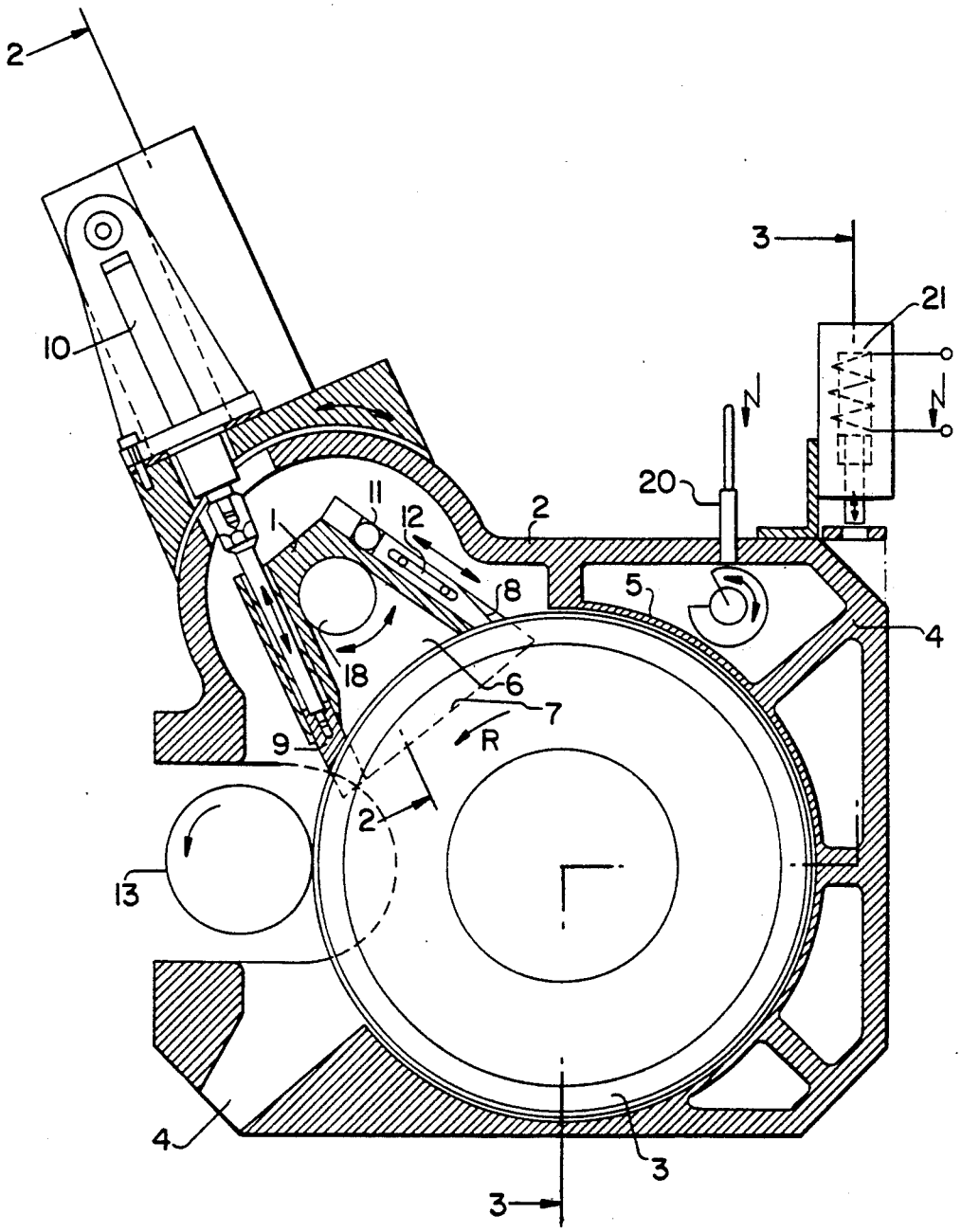
FIG. 1 is a transverse sectional view showing a guarded grinding wheel and means for supplying a cooling and lubricating fluid to said grinding wheel.

Further details will become apparent from the following description of a preferred embodiment of a grinding machine provided with means for supplying a cooling and lubricating fluid with reference to the drawing.

Figures 2, 4:
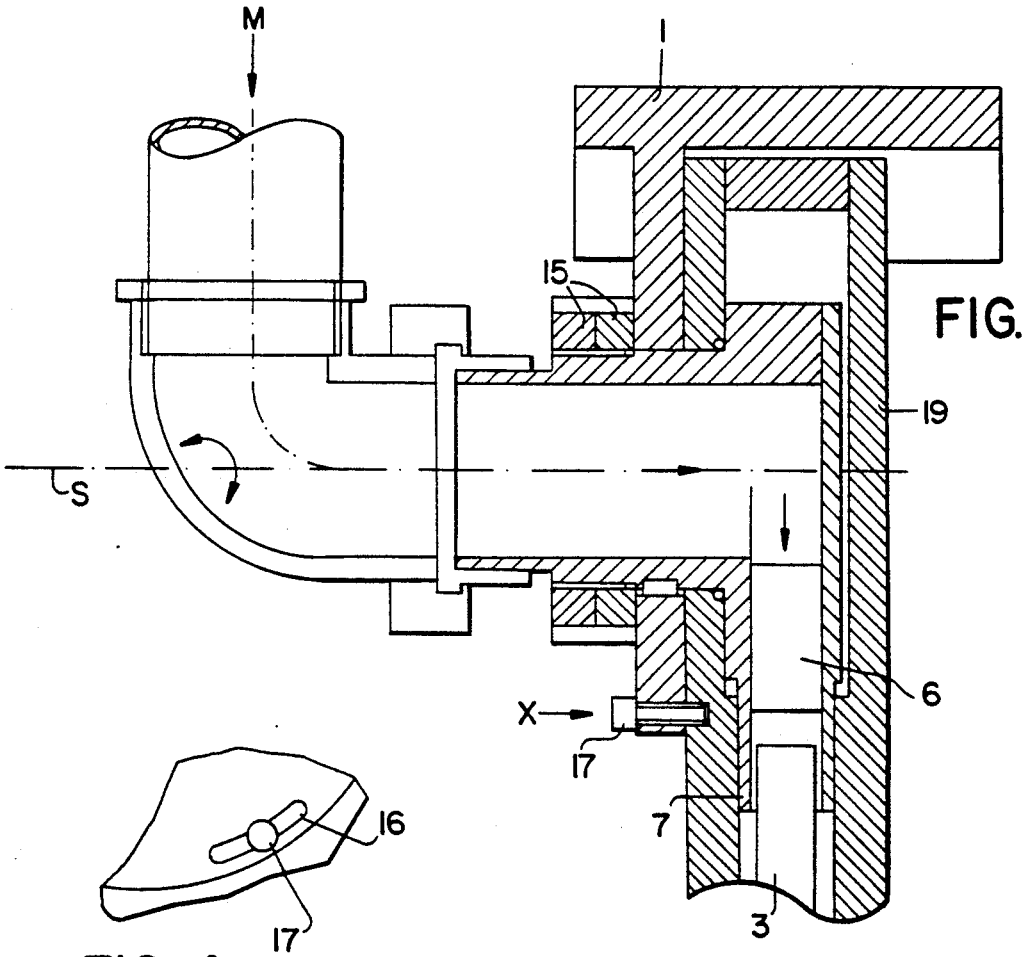
FIG. 2 is a sectional view taken on line A–B in FIG. 1.
FIG. 4 is a fragmentary elevation in the direction X in FIG. 2.
Figure 3:
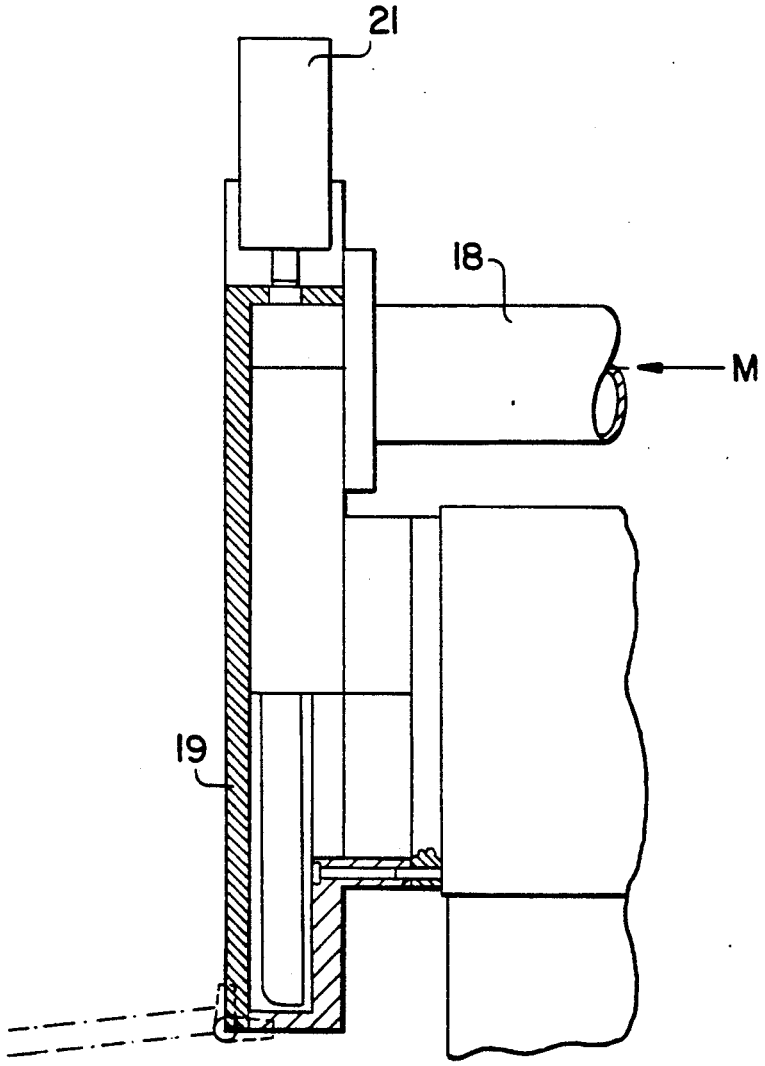
FIG. 3 is a sectional view taken on line C–D in FIG. 1.

As is apparent from FIGS. 1 to 3 of the drawing the means 1 for supplying a cooling and lubricating fluid M to the grinding wheel 3 of a machine for contour grinding the peripheral surface of workpieces at a high velocity are integrated in a guard hood 2, which has an inner peripheral wall 5, which surrounds and is closely spaced from the peripheral surface of the grinding wheel 3 and is mounted by webs 4 in an outer wall of said hood. Said fluid supply means 1 comprise a nozzle 6, the center line of which extends preferably radially with respect to the grinding wheel 3 and which has an interior cavity, which flares toward the peripheral surface of the grinding wheel and adjacent to the grinding wheel 3 has an outlet opening, which extends across and laterally protrudes from the grinding wheel 3 on opposite sides on that side adjacent to said opening which faces opposite to the direction of rotation R of the adjacent portion of the peripheral surface of the grinding wheel 3 the nozzle 6 is provided with a lip 8, which protrudes beyond the outlet opening toward the peripheral surface of the grinding wheel 3 and is adjustable toward and away from said peripheral surface. On that side which faces in the direction of rotation R of the adjacent portion of the peripheral surface of the grinding wheel 3 the nozzle 6 is provided with a slidably mounted valve member 9, which protrudes beyond the outlet opening toward the peripheral surface of the grinding wheel 3 and is adjustable by a power operable actuating means 10 toward and away from the peripheral surface of the grinding wheel 3. The actuating means including a feedback loop for controlling the volume flow rate at which the cooling and lubricating fluid is entrained from the nozzle 6 by the peripheral surface of the grinding wheel 3 past the valve member 9. That end face of said valve member 9 which faces the peripheral surface of the grinding wheel 3 has been ground by the grinding wheel 3 to conform to said peripheral surface.

The lip 8 with which the nozzle is provided at that end of its outlet opening which is remote from the workpiece contact with the grinding wheel 3 is connected to an eccentric mechanism 11 for a fine adjustment of said lip along a guiding slot 12 so that the lip 8 can be moved so close to the peripheral surface of the grinding wheel 3 that the air cushion which surrounds the rotating grinding wheel 3 owing to its high surface speed cannot enter the interior of the funnel-shaped nozzle 6 so that that interior can be filled with cooling and lubricating fluid under a low pressure and said fluid emerging out of said interior onto the peripheral surface of the rotating grinding wheel can be entrained by said peripheral surface at a high velocity.

The workpiece 13 is moved into engagement with the peripheral surface of the grinding wheel 3 in a horizontal direction and the center line of the nozzle 6 is downwardly inclined about 45° toward the radius which connects the centers of the grinding wheel 3 and the workpiece 13. Below said radius the guard hood 2 is provided with a drain passage 14, which serves to drain the cooling and lubricating fluid and has a center line that is approximately a mirror image of the center line of the nozzle 6 with respect to said radius.

The orientation of the nozzle 6 can be adjusted in that the nozzle 6 is rotated about an axis S, which is parallel to the axis of the grinding wheel 3. The freedom of pivotal movement of the nozzle 6 about the axis S is ensured by means of two groove nuts 15, which lock each other. The nozzle 6 is held at the desired angle to a direction which is radial with respect to the grinding wheel 3 by one or more clamp screws 17, which extend into a cardioid-shaped groove 16. The cooling and lubricating fluid supplied to the flaring nozzle 6 through a pipe or hose 18, which is centered on the pivotal axis S of the flaring nozzle 6.

To permit a change of the grinding wheel the guard hood 2 is provided on its front side with a hinged cover 19 and an inductive sensor 20 is provided to indicate that said cover is locked in position. An electro magnet 21 for locking the cover 19 in position is electrically controlled by a sensor that is response to the rotation of the motor for driving the grinding wheel and said electromagnet 21 will prevent an opening of the cover 19 unless the grinding wheel 3 is at a standstill.

We claim:

1. In a machine for contour grinding the peripheral surface of workpieces, comprising a grinding wheel having a wheel axis and operable to rotate in a predetermined sense about said wheel axis and having a peripheral surface including a grinding surface portion engageable by a workpiece to be ground, a guard hood covering said peripheral surface and leaving said grinding surface portion exposed, and a nozzle, which is disposed radially outwardly of said peripheral surface and defines an internal cavity, which flares toward said peripheral surface and adjacent to said peripheral surface has an opening which extends throughout the width of said peripheral surface, which nozzle is operable to discharge a cooling and lubricating fluid from said internal cavity through said opening onto said peripheral surface has first and second sides respectively facing opposite to and in the direction of movement of said peripheral surface adjacent to said nozzle when said grinding wheel is rotating in said predetermined sense, said nozzle being provided on said first side with a lip, which protrudes beyond said opening toward said peripheral surface and is adjustable toward and away from said peripheral surface, the improvement residing in that said nozzle is pivoted on an axis that is parallel to said wheel axis, said nozzle is provided on said second side with a slidable mounted valve member, which protrudes beyond said opening toward said peripheral surface and is adjustable toward and away from said peripheral surface, and said nozzle is provided with actuating means for adjusting said valve member toward and away from said peripheral surface to control the volume flow rate of said cooling and lubricating fluid on said peripheral surface past said valve member.

2. The improvement set forth in claim 1, wherein said actuating means are power-operable.

3. The improvement set forth in claim 2, wherein a feedback loop for controlling said actuating means to maintain a predetermined volume flow rate of said cooling and lubricating fluid past said valve member comprises means for sensing said volume flow rate.

4. The improvement set forth in claim 1, wherein said nozzle is accommodated by said guard hood.

5. The improvement set forth in claim 4, wherein said grinding surface portion is engageable by said workpiece when a center line of said workpiece lies on a predetermined radius of said grinding wheel, said nozzle has a center line which is inclined at an angle of about 45° to said predetermined radius opposite to said direction of movement, and said guard hood is provided with a drain passage which is open to said peripheral surface and has a center line which is substantially a mirror image of said center line of said nozzle with respect to said predetermined radius.

6. The improvement set forth in claim 1, wherein a line connected to said nozzle and communicating with said cavity to supply said cooling and lubricating fluid to said cavity has a center line which coincides with said pivotal axis.

* * * * *